US012304710B2

(12) United States Patent
Feng et al.

(10) Patent No.: US 12,304,710 B2
(45) Date of Patent: May 20, 2025

(54) CAP AND A CONTAINER

(71) Applicant: Conopco, Inc., Englewood Cliffs, NJ (US)

(72) Inventors: Keke Feng, Shanghai (CN); Jun Shen, Shanghai (CN); Sainan Su, Shanghai (CN); Zhiwen Xing, Shanghai (CN); Lixiao Zhang, Shanghai (CN)

(73) Assignee: Conopco Inc., Englewood Cliffs, NJ (US)

( * ) Notice: Subject to any disclaimer, the term of this patent is extended or adjusted under 35 U.S.C. 154(b) by 0 days.

(21) Appl. No.: 18/006,161

(22) PCT Filed: Aug. 3, 2021

(86) PCT No.: PCT/EP2021/071599
§ 371 (c)(1),
(2) Date: Jan. 20, 2023

(87) PCT Pub. No.: WO2022/033915
PCT Pub. Date: Feb. 17, 2022

(65) Prior Publication Data

US 2023/0294885 A1 Sep. 21, 2023

(30) Foreign Application Priority Data

Aug. 12, 2020 (WO) ..... PCT/CN2020/108728
Sep. 21, 2020 (EP) ..... 20197113

(51) Int. Cl.
*B65D 51/16* (2006.01)
*B65D 41/48* (2006.01)
(Continued)

(52) U.S. Cl.
CPC ..... *B65D 51/1672* (2013.01); *B65D 41/485* (2013.01); *B65D 43/162* (2013.01);
(Continued)

(58) Field of Classification Search
CPC ..... B65D 51/1672; B65D 41/485; B65D 43/162; B65D 51/18; B65D 55/06;
(Continued)

(56) References Cited

U.S. PATENT DOCUMENTS 3,059,816 A * 10/1962 Goldstein ..... B65D 47/0842 222/545
3,927,784 A 12/1975 Cochrane
(Continued)

FOREIGN PATENT DOCUMENTS

CH 331168 7/1958
CN 102612473 7/2012
(Continued)

*Primary Examiner* — James N Smalley
(74) *Attorney, Agent, or Firm* — N.V. Nederlandsch Octrooibureau

(57) ABSTRACT

Disclosed is a cap (4) for a container (1) and a container (1) thereof. The cap (4) configured to be mounted on the container body (2) comprises a cap body (15) formed with a liquid path (24) and a gas path (25) therein, wherein the liquid path (24) is configured for liquid to go through from the container (1) and the gas path (25) is configured for gas to go through to balance pressures inside and outside the container (1), and a top plate (16); characterized in that the top plate (16) is detachably connected with the cap body (15) to seal the liquid path (24) and the gas path (25).

17 Claims, 8 Drawing Sheets

(51) Int. Cl.
*B65D 43/16* (2006.01)
*B65D 51/18* (2006.01)
*B65D 55/06* (2006.01)

(52) U.S. Cl.
CPC ..... *B65D 51/18* (2013.01); *B65D 55/06* (2013.01); *B65D 2205/00* (2013.01); *B65D 2251/0021* (2013.01); *B65D 2251/0046* (2013.01); *B65D 2401/25* (2020.05); *B65D 2543/00046* (2013.01); *B65D 2543/00092* (2013.01); *B65D 2543/00296* (2013.01); *B65D 2543/0099* (2013.01); *B65D 2555/025* (2013.01)

(58) Field of Classification Search
CPC ..... B65D 2205/00; B65D 2251/0021; B65D 2251/0046; B65D 2401/25; B65D 2555/025
USPC ..... 215/235, 237, 253; 222/556
See application file for complete search history.

(56) References Cited

U.S. PATENT DOCUMENTS

| | | | | |
|---|---|---|---|---|
| 4,354,610 | A | 10/1982 | Kessler et al. | |
| 4,595,111 | A * | 6/1986 | Gould | B65D 43/0222 215/303 |
| 4,782,985 | A * | 11/1988 | Kinsley | B65D 47/0814 222/481.5 |
| 4,838,441 | A * | 6/1989 | Chernack | B65D 47/0838 222/153.1 |
| 5,228,603 | A * | 7/1993 | Pham | B65D 47/04 222/479 |
| 5,289,950 | A | 3/1994 | Gentile | |
| 5,711,443 | A | 1/1998 | Bennett | |
| 5,769,253 | A * | 6/1998 | Gross | B65D 47/0814 215/237 |
| 6,170,719 | B1 * | 1/2001 | Wilkinson | B01L 3/50825 222/479 |
| 6,702,137 | B1 * | 3/2004 | Kowa | A47J 41/0027 220/254.1 |
| 8,371,474 | B2 | 2/2013 | Tramontina et al. | |
| 9,884,706 | B1 * | 2/2018 | Skillin | B65D 41/34 |
| 2008/0314935 | A1 | 12/2008 | Mollins et al. | |
| 2015/0298150 | A1 | 10/2015 | Park | |

FOREIGN PATENT DOCUMENTS

| | | | |
|---|---|---|---|
| CN | 104309919 | | 1/2015 |
| CN | 1053314247 | | 2/2016 |
| CN | 207429385 | | 6/2018 |
| CN | 211168077 | | 8/2020 |
| DE | 955572 | C | 1/1957 |
| EP | 0137908 | | 4/1985 |
| FR | 2203747 | | 5/1974 |
| FR | 2354257 | | 1/1978 |
| GB | 1082809 | A | 9/1967 |
| JP | 2006232380 | | 9/2006 |
| JP | 2006232380 | A | 9/2006 |
| JP | 2018062372 | | 4/2018 |
| KR | 20030015167 | A | 2/2003 |

* cited by examiner

CAP AND A CONTAINER

FIELD OF THE INVENTION

The present invention is related to a cap for a container and a container thereof for a dispensing device.

BACKGROUND OF THE INVENTION

Dispensing device is widely used now at home or in public areas such as restaurants, airports, public restrooms to provide cleansing liquid like hand sanitizers. Auto-dispensing device has also been developed recently and used where a hand-free operation is needed.

The cleansing liquid is usually stored in a container which is designed to fit with the dispensing device. The container is used as a consumable which can be replaced with a new one when the cleansing liquid is fully consumed.

Several types of caps have been used for dispensing products from such containers. Some caps are not firmly connected to a neck of the container that may cause accidental leakage of the product from the container. In addition, it is also easy for someone to open the cap and replace the product with other compositions. Some caps request complicated structures to seal the container. They usually adopt the design of inner and outer covers with an additional sealing pad to seal the opening of the container. Such a structure makes replacement of the container complicated. When the container is to be replaced, users will have to remove both the outer cover and the sealing pad for the container to be mounted onto the dispensing device. Such complicated handling procedure deteriorates user experience.

KR20030015167 A discloses a stopper of a liquid container comprises a container having a take-up end at an injection port; and a stopper composed of a body being forcedly coupled to the container and having an outlet and an air suction port and a cover connected and disposed at the body by a connection portion.

JP2018062372 A discloses an ink replenishment container for injecting ink to an ink tank that has improved easiness of ink injection from the ink replenishment container to the ink tank and prevents dripping of ink. The ink replenishment container comprises a drum portion for storing ink, a shoulder portion provided at an edge of the drum portion, and a mouth portion connected to the shoulder portion.

U.S. Pat. No. 3,059,816 A discloses the shipping, storage and dispensing of fluent materials and more particularly to a combination container closure and pouring device which facilitates dispensing the contents of the container and, at the same time, provides for proper sealing thereof, in order to protect the contents during periods between dispensing thereof.

U.S. Pat. No. 5,289,950 A discloses a package for at least two substances which can be dispensed simultaneously. The package comprises a closure system comprising an inclined crown portion, at least two pouring spouts extending upwardly from the upper surface of the crown and a cover for securement to the crown portion, the cover being provided with depending plugs to close the closure.

U.S. Pat. No. 9,884,706 B1 discloses a one-piece dispensing closure for dispensing essential oils includes an integrally formed closure body, tubular dispensing spout, a hinged cap, a tamper-evident closure system and a latch for maintaining the cap in an open position.

Therefore, the present inventors have recognized a need to develop a cap for a container that simplifies the replacement procedure for the container while preventing accidental leakage of products from the container.

SUMMARY OF THE INVENTION

In a first aspect, the present invention is directed to a cap for a container to be mounted on a container body comprising a cap body formed with a liquid path and a gas path therein, wherein the liquid path is configured for liquid to go through from the container and the gas path is configured for gas to go through to balance pressures inside and outside the container, and a top plate, characterized in that the top plate is detachably connected with the cap body to seal the liquid path and the gas path.

The cap with a cap body integral with a detachable top plate allows users to open the cap through a simple one-step operation by removing the top plate, which greatly improves user experience with a simplified structure.

In a second aspect, the present invention is directed to a container comprising a container body and a cap of any embodiment of the first aspect of this invention configured to be mounted on the container body.

These and other aspects of the present invention will more readily become apparent upon considering the detailed description and examples which follow.

DESCRIPTION OF THE SYMBOLS

Figure 1:
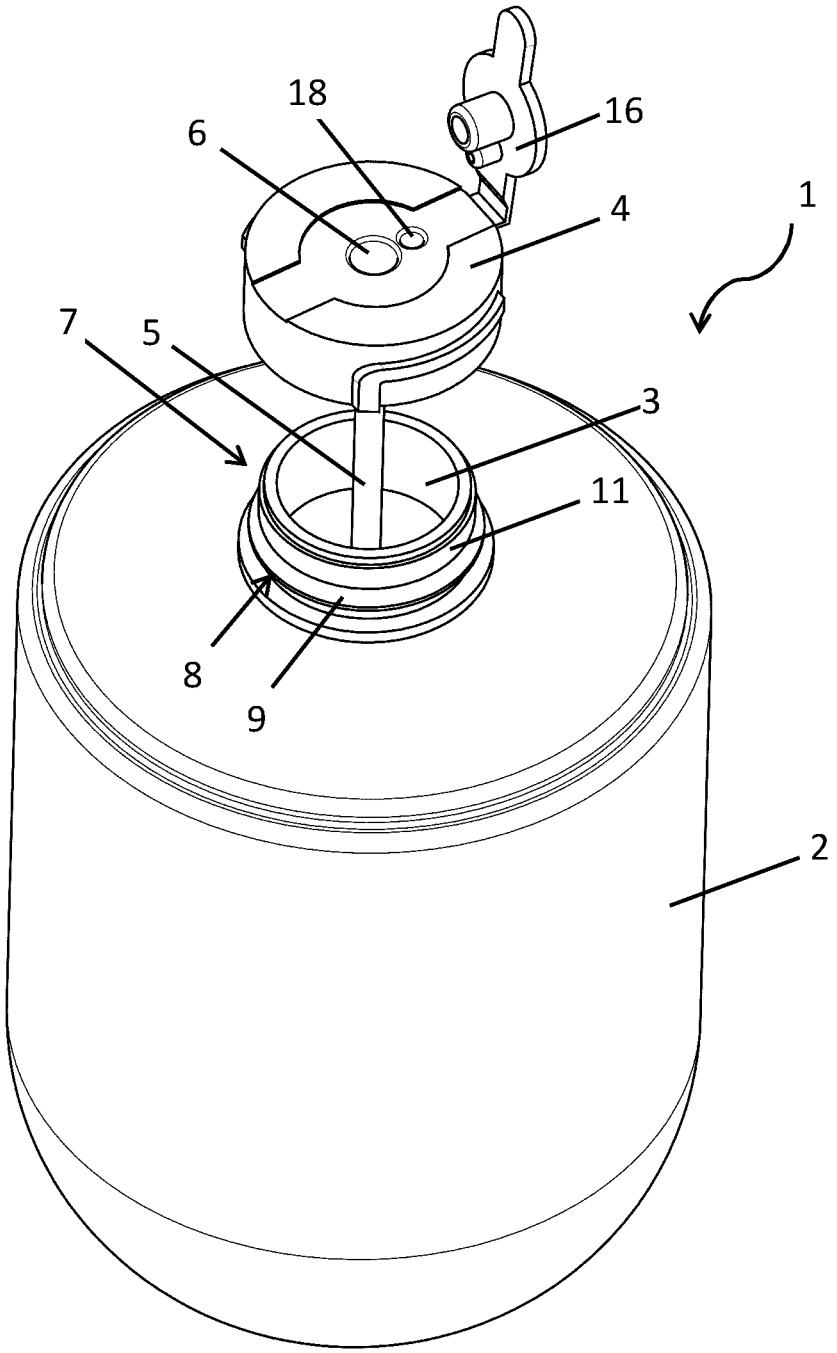
FIG. 1 is a perspective view of a preferred embodiment of a container for dispensing device according to the present invention.

1 container
2 container body
3 opening
4 cap
5 tube
6 liquid outlet
7 neck
8 interlocking structure
9 first flange
10 second flange
11 outer wall surface
12 loop
13 tab
14 weakening portion
15 cap body
16 top plate

17 top wall
18 gas hole
19 peripheral wall
20 recess
21 central portion
22, 23 strip portion
24 liquid path
25 gas path
26 annular protrusion
27 extension
28 rib
29 hinge
30 main body
31 grasping part
32 connecting part
33, 34 protrusion
35, 38 notch

DETAILED DESCRIPTION OF THE INVENTION

Except in the examples, or where otherwise explicitly indicated, all numbers in this description indicating amounts of material or conditions of reaction, physical properties of materials and/or use may optionally be understood as modified by the word "about".

It should be noted that in specifying any range of values, any particular upper value can be associated with any particular lower value.

For the avoidance of doubt, the word "comprising" is intended to mean "including" but not necessarily "consisting of" or "composed of". In other words, the listed steps or options need not be exhaustive.

For the convenience of description, terms indicating directions such as "upper", "lower", "top", "bottom", "above", "below", "inner", "outer", "inward", "outward", "inside", "outside", and the like are intended to explain relative positions among components of the container only, and should not be construed as limiting the scopes of the present invention.

The disclosure of the invention as found herein is to be considered to cover all embodiments as found in the claims as being multiply dependent upon each other irrespective of the fact that claims may be found without multiple dependency or redundancy.

Where a feature is disclosed with respect to a particular aspect of the invention (for example a product of the invention), such disclosure is also to be considered to apply to any other aspect of the invention (for example a process of the invention) mutatis mutandis.

The present invention relates to a cap for a container which is particularly for a dispensing device. The container comprises a container body, and the cap is configured to be mounted on the container body.

The container is preferably elongate. The container body is also preferably elongate meaning that the longitudinal dimension of the container body is longer than the lateral dimension. The container body may be in any suitable shape, for example polyhedron, cylinder, truncated cone, sphere shaped or in shape of animals. It is preferable that the container is in shape of polyhedron, cylinder, or truncated cone, more preferably in shape of cylinder or truncated cone. Most preferably the container body is in shape of cylinder.

Preferably, the container body is made of polymeric material, more preferably a rigid plastic material. Examples of suitable plastic materials include high density polyethylene ("HDPE"), low density polyethylene ("LDPE"), polyethylene terephthalate ("PET"), polypropylene ("PP"), polyvinyl chloride, polycarbonate, nylon, and fluorinated ethylene propylene. HDPE, PP or PET is especially preferred. The container body can be made via various processes, such as blow molding, injection molding. Preferably the container body of the present invention is made of HDPE or PP via an extrusion blow molding process, or PET via an injection blow molding process.

The container may be used to store any suitable consumer products, for example personal care products or home care products. Preferably, the container comprises a cleansing product, more preferably a cleansing product comprising cleansing surfactants. Preferably, the container comprises a consumer product having a viscosity of at least 10 mPa·s, more preferably in the range 30 to 10000 mPa·s, even more preferably 50 to 5000, and most preferably 100 to 2000 mPa·s, when measured at 20 degrees C. at a relatively high shear rate of about 20 $s^{-1}$. Preferably, the container comprises a cleansing product in the form of fluid, more preferably a liquid composition.

The cap that is configured to be mounted on the container body comprises a cap body formed with a liquid path and a gas path therein, wherein the liquid path is configured for liquid to go through from the container and the gas path is configured for gas to go through to balance pressures inside and outside the container, and a top plate detachably connected with the cap body to seal the liquid path and the gas path.

The top plate is connected with the cap body solely via an easily torn off structure so that the top plate may be torn off before the container is in use. The easily torn off structure serves as the only connection between the top plate and the cap body. The top plate is completely detached from the cap body when the easily torn off structure is torn off. The easily torn off structure is preferably made of a material which is more easily torn off than that of the remaining portions of the cap. Preferably, the easily torn off structure is provided with a weakening portion with an optional notch for tearing. For example, the weakening portions are weakening lines, perforated holes, thinned portions, cutouts, notches, or combinations thereof. The easily torn off structure may be made of plastic with a thickness of 0.1 to 3 mm, preferably 0.3 to 1 mm. If the weakening portion comprises a notch, the notch is formed at one edge or both edges of the weakening portion. With such an easily torn off structure, users may remove the top plate with a simple one-step operation by hand, which greatly improves usage experience.

Preferably, the easily torn off structure is in the form of a hinge, or a loop extending at least partly in a circumferential direction. When the structure is in the form of a hinge, the hinge is preferably located at one end of the top plate. When the structure is in the form of a loop, the loop may extend along at least a portion, preferably the entirety, of a periphery of the main body of the top plate.

Preferably, the loop is sandwiched between the top plate and the cap body, provided with weakening portions located on both upper and lower surfaces of the loop that are in contact with the top plate and the cap body so that it may be torn off from the two members simultaneously. The loop may also surround the cap body and the top plate from outside, and provided with a weakening portion on its inner surface that is in contact with the top plate and the cap body. Alternatively, the loop is provided with a weakening portion on a surface contacting with the cap body only so that it may be torn off from the cap body while still remaining on the top plate. In another preferred embodiment, the loop itself is formed as a weakening portion.

Preferably, the cap is integrally formed into a single piece. That is, the cap body, the easily torn off structure and the top plate are integrated into one piece.

Preferably, the cap body is formed with a top wall thereof with a recess through which both the liquid path and the gas path extend. The liquid path is preferably located in the center of the recess and the gas path is adjacent to it.

Preferably, the top plate is dimensioned to be received in the recess in order to save materials and achieve an aesthetic appearance. Alternatively, the top plate extends above and beyond the recess. For example, the top plate extends beyond the recess until the periphery of the cap body so that the top plate is flush with the cap body in the periphery. An extension may be provided in the recess to receive the top plate. The extension may extend in the recess partially or wholly in the circumferential direction. Alternatively, the top plate is directly positioned in the recess without any intermediate members.

Preferably, the top plate is provided with two protrusions to be press fitted into a liquid outlet and a gas hole, which are provided in the cap body as part of the respective liquid path and gas path, respectively. Therefore, a leak-tight seal is created between the top plate and the cap body without any additional sealing members. The top plate serves as a sealing member to seal the liquid path and the gas path, and also as an outer cover for the cap, which simplifiers the cap structure while providing leak-proof closure.

Preferably, a tube is arranged at the cap body to communicate with the liquid path. The tube may be inserted into the liquid path as a separate member. Alternatively, the tube may be formed with the cap integrally.

Preferably, a tamp-proof feature such as an interlocking structure is arranged between the cap and the container body to prevent the cap from being removed. More preferably, the interlocking structure is configured as a pair of barb-like flanges extending circumferentially.

The container body and the cap are preferably adapted to be releasably engageable to each. Such a releasable engagement is preferably a snap-fit connection. There may be no thread connection between the cap and the container body. Alternatively, the cap makes interference fit with the container body.

EXAMPLES

The following examples are provided in FIGS. 1 to 7*c* to facilitate an understanding of the invention. The examples are not intended to limit the scope of the claims.

Example 1

FIG. 1 shows an overall configuration of a container 1 for a dispensing device. The container 1 is configured to be used with the dispensing device (not shown) to dispense products to users.

The container 1 comprises a hollow container body 2 with an opening 3. A cap 4 is attached to the container body 2 to seal the opening 3. The cap 4 is provided with a tube 5 which is inserted into the container body 2 through the opening 3 to direct liquid from the container 1 to a liquid outlet 6 of the cap 4.

As shown in FIG. 1, the container body 2 is formed with a neck 7 with the opening 3 formed inside. The cap 4 covers the top of the neck 7 to prevent liquid leakage during storage or transportation of the container 1. When the container 1 is intended to be mounted onto the dispensing device, the cap 4 is opened while still attached to the container body 2 and the liquid will be pumped out by the dispensing device through the liquid outlet 6 of the cap 4 for use.

Figure 2:
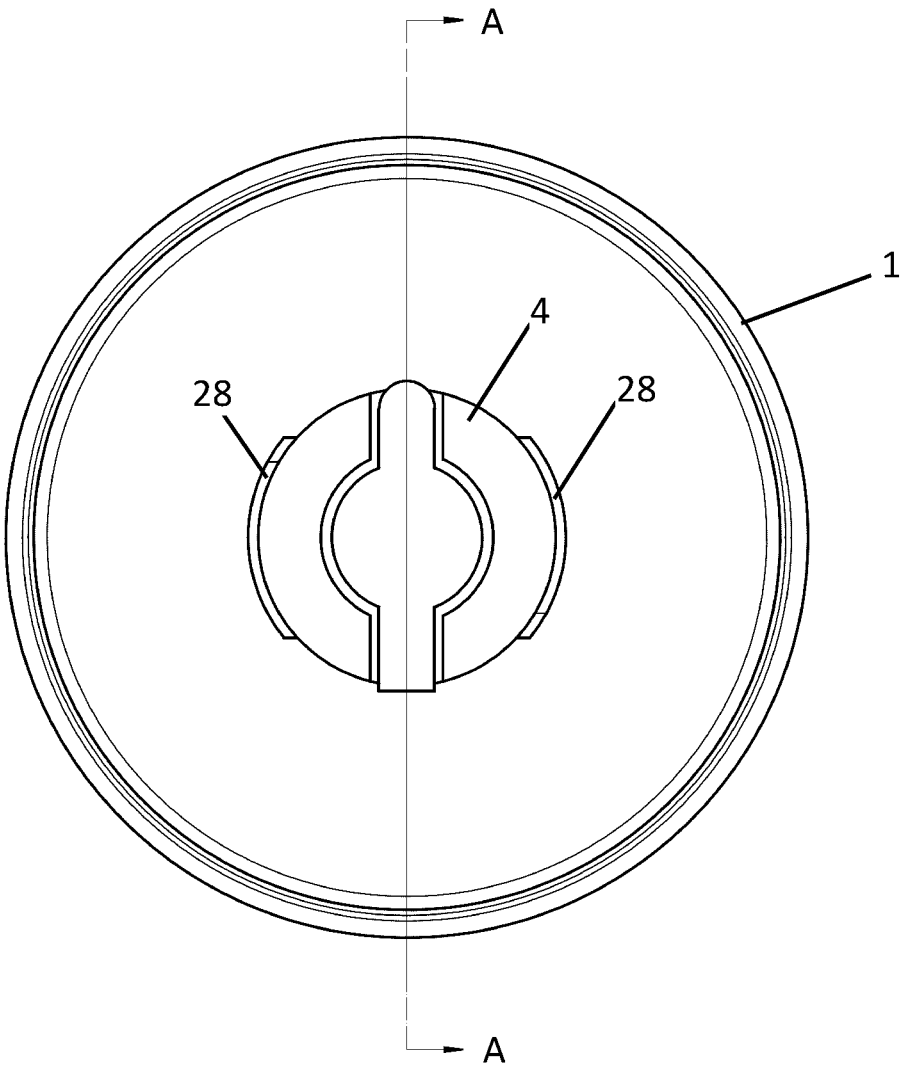
FIG. 2 is a top view of the container as shown in FIG. 1.
Figure 3:
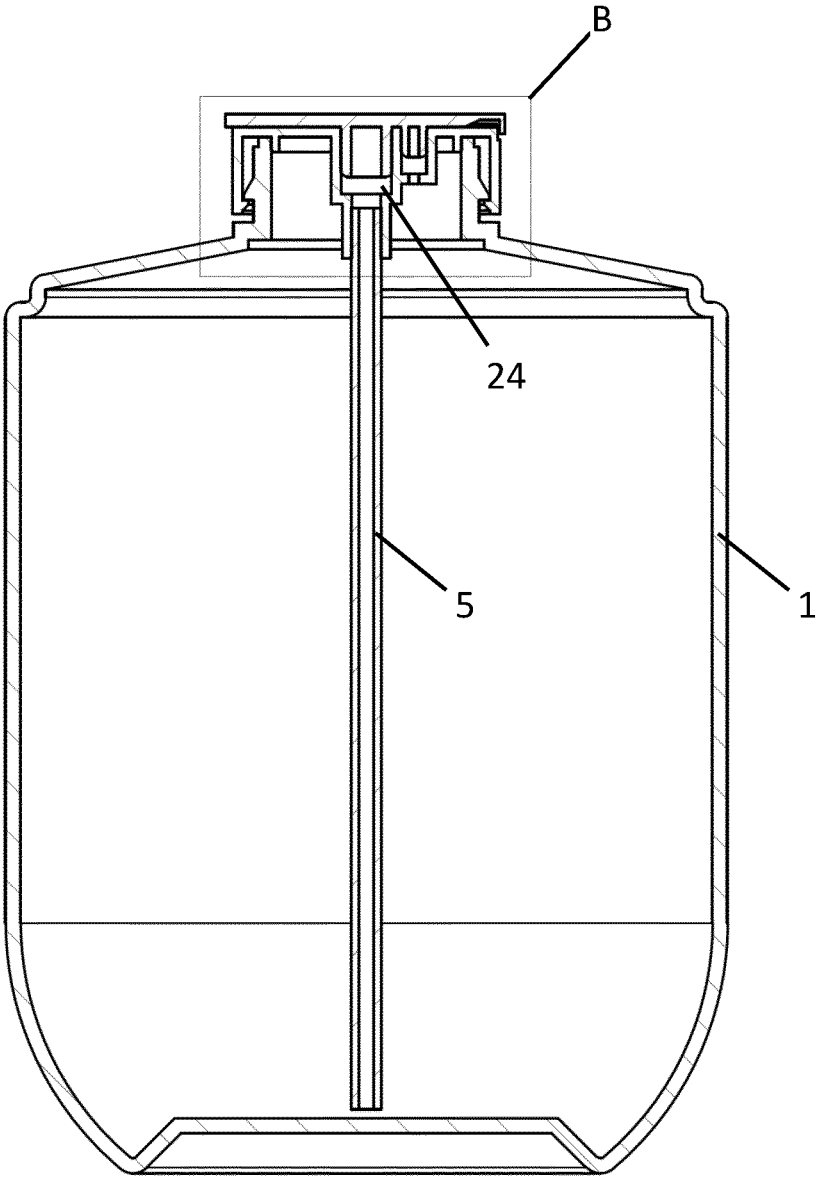
FIG. 3 is a sectional view taken along the line A-A as shown in FIG. 2.
Figure 4:
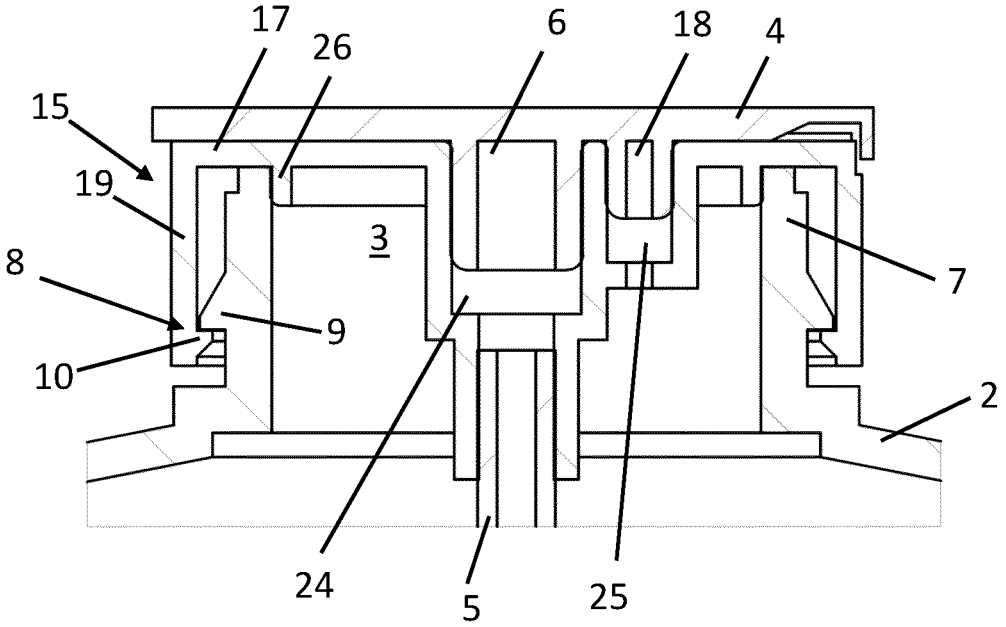
FIG. 4 is an enlarged view of the portion B as indicated in FIG. 3.

FIG. 2 is a top view of the container 1 with the cap 4 in position, FIG. 3 is a sectional view taken along the line A-A in FIG. 2, and FIG. 4 is an enlarged view of the portion B encircled by a rectangle in FIG. 3.

With reference to FIGS. 1 and 4, the container 1 is provided with a tamp-proof feature to prevent the cap 4 from being removed intentionally or accidentally. The tamp-proof feature is in the form of an interlocking structure 8 at a connection between the neck 7 and the cap 4. The interlocking structure 8 is a pair of barb-like flanges 9, 10 which extend circumferentially at the neck 7 and the cap 4 of the container 1 respectively. When the cap 4 is attached to the container body 2, the flanges 9, 10 abut against and interlock with each other to prevent the cap 4 from being removed. With the interlocking structure 8, liquid inside the container 1 cannot be intentionally dumped or replaced with other compositions.

As shown in FIG. 1, a first flange 9 is arranged at an outer wall surface 11 of the neck 7 of the container 1. The first flange 9 extends all around the neck 7 in a circumferential direction.

Figure 5A:
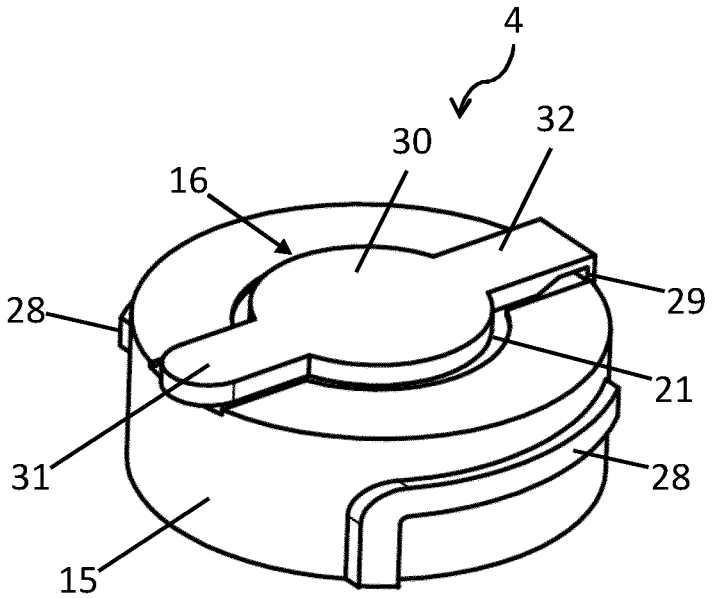
FIGS. 5*a* and 5*b* are perspective views of a first preferred embodiment of a cap according to the present invention in a closed state and an opened state respectively.
Figure 5B:
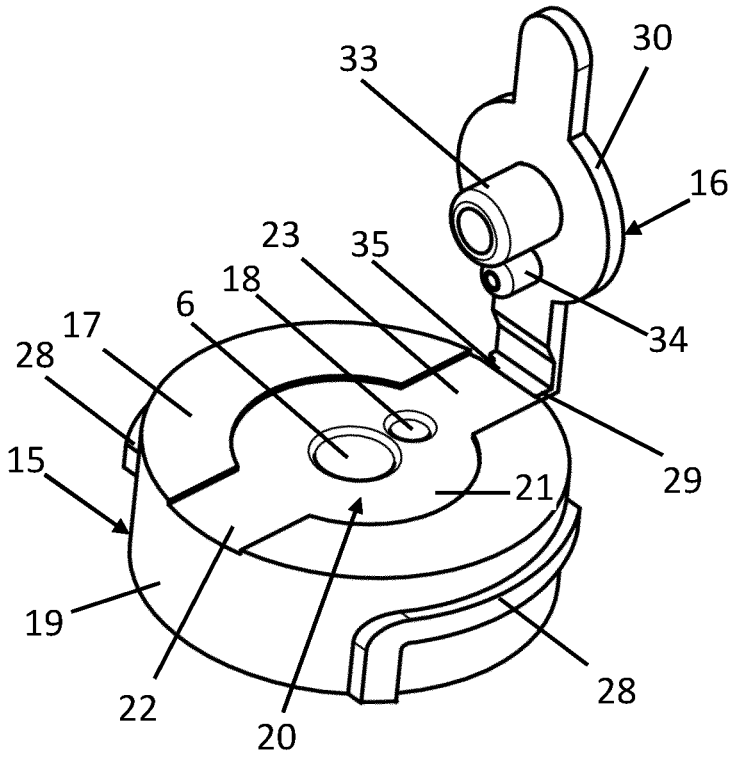

FIGS. 5*a* and 5*b* schematically show the cap 4 in a closed and an opened state respectively.

As shown in FIGS. 5*a* and 5*b*, the cap 4 comprises a cap body 15 and a top plate 16 detachably connected with the cap body 15. Thus, the cap 4 is integrally formed into one piece. The cap body 15 is configured to provide with a liquid path and a gas path which are described in detail below for dispensing liquid by the dispensing device. The top plate 16 is configured to seal the liquid path and the gas path before dispensing to prevent liquid leakage, and is further configured to be removable from the cap body 15 when the container 1 is to be mounted onto the dispensing device to expose the liquid path and the gas path for dispensing.

Cap 4 comprising a cap body 15 and a top plate 16 provides leak tight closure without any additional sealing members. In addition, users can open cap 4 by a simple one-step operation by removing the top plate 16, which thereby reduces actions of users and greatly improves user experience.

With reference to FIG. 5*b*, the cap body 15 includes a top wall 17 formed with a liquid outlet 6 and a gas hole 18, and a peripheral wall 19 depending from the top wall 17. The liquid outlet 6 is located centrally in the top wall 17 to facilitate outflow of liquid. The gas hole 18 is adjacent to the liquid outlet 6 to balance pressures inside and outside the container 1 during dispensing.

A recess 20 is formed in the top wall 17 to communicate an interior of the container 1 with outside air during dispensing and constitutes part of the gas path. The recess 20 is shaped to receive the top plate 16, and is complementary with it. The recess 20 has a central portion 21 and two strip portions 22, 23 extending outward from the central portion 21 diametrically to match the top plate 16. The liquid outlet 6 and the gas hole 18 are positioned in the central portion 21.

Returning now to FIG. 4, a liquid path 24 is formed inside the cap body 15 and terminates at the liquid outlet 6. Into the end of the liquid path 24 opposite from the liquid outlet 6, the tube 5 is inserted to guide a liquid flow. Similarly, a gas path 25 is formed inside the cap body 15 at the gas hole 18. In order to prevent liquid from leaking outside the container 1, an annular protrusion 26 is arranged on a lower surface of the top wall 17. When the cap 4 is attached to the container body 2, the annular protrusion 26 is plugged into the opening 3 of the container 1 fluid-tightly and interference fit is formed therebetween.

As shown in FIG. 3, the tube 5 is inserted into the liquid path 24 at one end and extends into the liquid inside the container 1 at the other end. When the container 1 is in use, the liquid is directed into the dispensing device through the tube 5, the liquid path 24 and the liquid outlet 6 constitute the liquid path. During dispensing, air flows through the recess 20, the gas hole 18 and the gas path 25 which constitute the gas path to balance pressures inside and outside the container 1 so that the liquid may flow out from the container smoothly.

Referring now to FIG. 4, as part of the interlocking structure 8 of the container 1, the second flange 10 is arranged on an inner surface of the peripheral wall 19 of the cap 4 at a position corresponding to the first flange 9. The second flange 10 is shown positioned at a lower end of the peripheral wall 19. Like the first flange 9, the second flange 10 also extends all around the cap 4 in the circumferential direction.

When the cap 4 is being attached to the container body 2, the second flange 10 slides on the first flange 9 and the peripheral wall 19 of the cap 4 slightly expands radially outwardly. Once the second flange 10 slides beyond the first flange 9, the peripheral wall 19 of the cap 4 returns to its original shape under the action of elasticity, and thereby the second flange 10 faces and abuts against the first flange 9 from underside so that the cap 4 can hardly be removed from the container body 2.

On an outer surface of the peripheral wall 19, there are arranged two ribs 28 protruding therefrom for attachment of the container 1 to the dispensing device. The ribs 28 are arranged evenly in the circumferential direction so that the container 1 may be positioned firmly on the dispensing device. As can be seen in FIGS. 5*a* and 5*b*, the rib 28 is generally L-shaped.

Continuing referring to FIGS. 5*a* and 5*b*, the top plate 16 is detachably connected with the cap body 15 via a hinge 29 at one end of the top plate 16. In the closed state of FIG. 5*a*, the top plate 16 covers the liquid outlet 6 and the gas hole 18 in the cap body 15 to prevent liquid leakage during storage or transportation of the container 1, while in the opened state of FIG. 5*b*, the top plate 16 is pivoted away from the cap body 15 to expose the liquid outlet 6 and the gas hole 18 and then is torn off for attachment of the container 1 to the dispensing device.

As can be seen in FIG. 5*a*, the top plate 16 has a main body 30 to be fitted into the central portion 21 of the recess 20 in the cap body 15. A grasping part 31 extends from the main body 30 radially outward for grasping by a user to remove the top plate 16. A connecting part 32 extends from the main body 30 to the hinge 29 in an opposite direction from the grasping part 31. The grasping part 31 and the connecting part 32 are fit into the two strip portions 22, 23 of the recess 20 (shown in FIG. 5*b*) respectively.

Referring to FIG. 5*b*, two protrusions 33, 34 are arranged on the main body 30 at the side of the cap body 15, with a first protrusion 33 and a second protrusion 34 configured to be inserted into the liquid outlet 6 and the gas hole 18 respectively in a fluid-tight manner to form interference fit therebetween, thereby inhibiting liquid leakage during storage or transportation. The two protrusions 33, 34 function as sealing portions of the top plate 16.

The hinge 29 is provided with a thinned portion with a thickness of 0.5 mm, and is made of plastic. The hinge 29 is an integral part of the cap 4. That is, the top plate 16, the hinge 29 and the cap body 15 are integrated into one piece. For ease of tearing, a notch 35 is formed at an edge of the hinge 29.

When the container 1 is intended to be mounted onto the dispensing device, a user grasps the grasping part 31 and then pivots the top plate 16 away from the cap body 15 to expose the liquid outlet 6 and the gas hole 18 simultaneously. Then he or she tears the top plate 16 off along the notch 35 and the weakening portion in the hinge 29, so that the container 1 can be attached to the dispensing device without the top plate 16. Users may easily tear off the top plate 16 through a simple one-step operation by hand before using the container 1, which greatly improves user experience.

Example 2

Example 2 will be described below with reference to FIGS. 6*a*-6*c*. Example 2 differs from Example 1 in the cap 4 while other structures of the container 1 are similar. Therefore, redundant descriptions of the same or similar structures are omitted here.

Figure 6A:
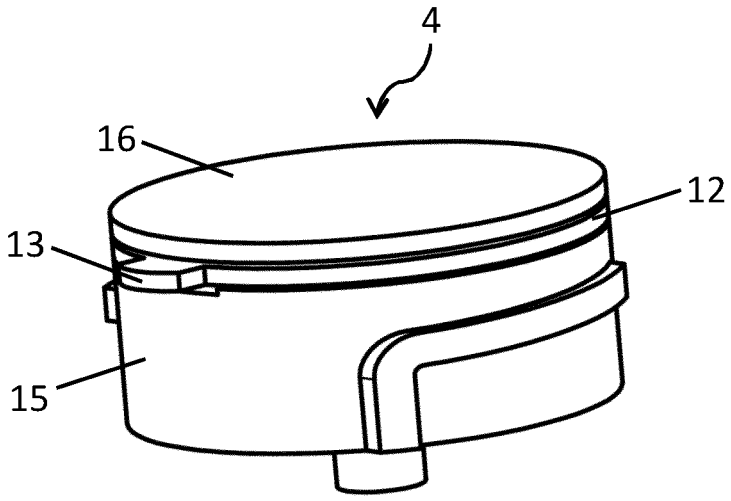
FIG. 6*a* is a perspective view of a second preferred embodiment of the cap according to the present invention in a closed state.

FIG. 6*a* shows a modification of the cap 4 in a closed state. FIGS. 6*b* and 6*c* are exploded perspective views of the cap 4 shown in FIG. 6*a* as seen from above and below respectively.

Figure 6B:
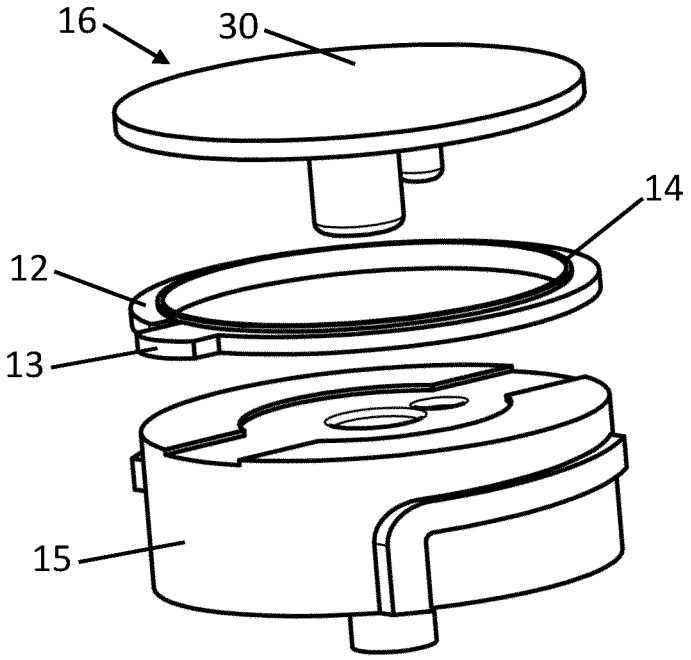
FIGS. 6*b* and 6*c* are exploded views of the cap in FIG. 6*a* as seen from above and below respectively.
Figure 6C:
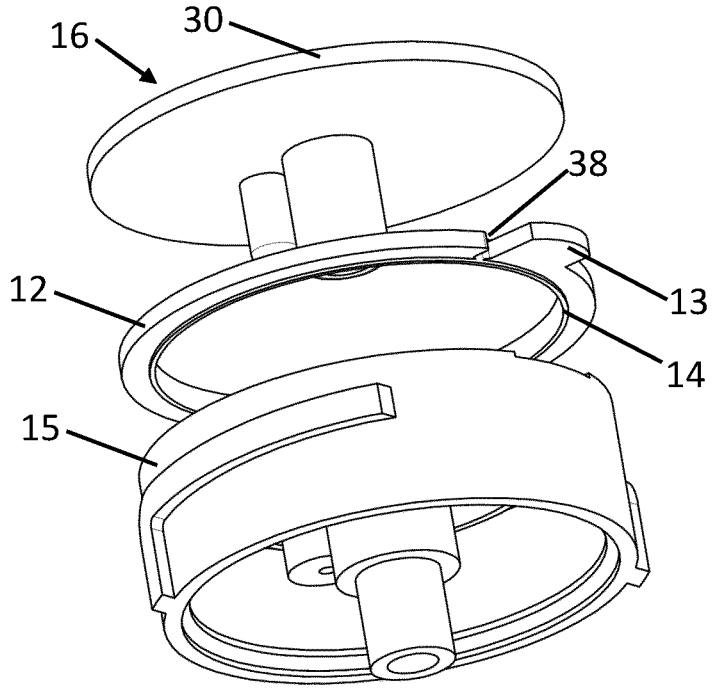

The cap 4 shown in FIGS. 6*a* to 6*c* is different from that shown in FIGS. 5*a* and 5*b* in the shape of the top plate 16 and the connection between the top plate 16 and the cap body 15.

In the closed state shown in FIG. 6*a*, the top plate 16 and the cap body 15 are integrated into one piece via a loop 12. The loop 12 is sandwiched between the top plate 16 and the cap body 15 and extends in the circumferential direction in place of the hinge 29 in the previous example. The loop 12 is formed with a tab 13 for grasping. As shown in FIG. 6*c*, there is a notch 38 near the tab 13 for pulling off the loop 12 easily.

As can be best seen in FIGS. 6*b* and 6*c*, the top plate 16 has a main body 30 in the form of a circular disk, and the loop 12 is arranged with weakening portions 14 on its upper and lower surfaces to be connected with the top plate 16 and the cap body 15. The weakening portion 14 is a thinned portion of material. When the container 1 is to be attached to the dispensing device, a user grasps the tab 13 on the loop 12 and pulls it away from the top plate 16 and the cap body 15 to detach the loop 12 therefrom. After the loop 12 is torn off, the top plate 16 is removed for subsequent attaching of the container 1 to the dispensing device.

With the easily torn off loop 12, users can easily tear off the top plate 16 through a simple one-step operation by hand before using the container 1.

Example 3

Example 3 will be described below with reference to FIGS. 7*a*-7*c*. Example 3 differs from Example 1 in the cap 4 while other structures of the container 1 are similar. Therefore, redundant descriptions of the same or similar structures are omitted here.

Figure 7A:
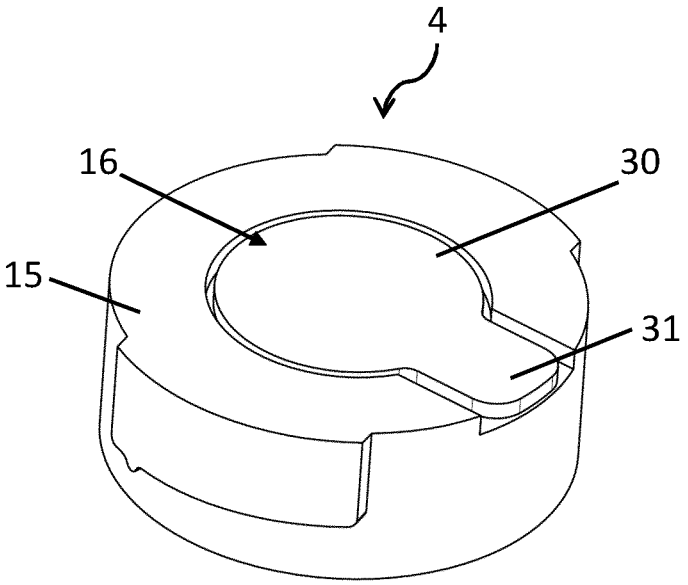
FIG. 7*a* is a perspective view of a third preferred embodiment of the cap according to the present invention in a closed state.

FIG. 7*a* shows a modification of the cap 4 in a closed state. FIGS. 7*b* and 7*c* are exploded perspective views of the cap shown in FIG. 7*a* as seen from above and below respectively.

Figure 7B:
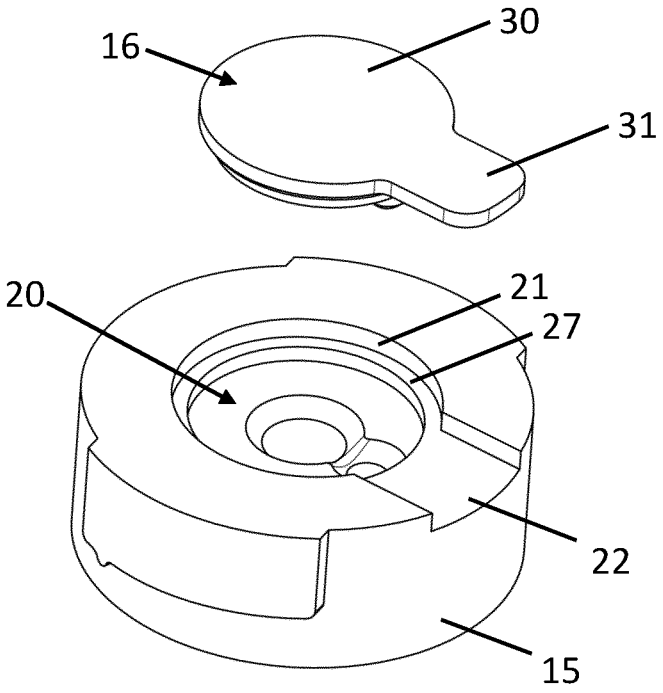
FIGS. 7*b* and 7*c* are exploded views of the cap in FIG. 7*a* as seen from above and below respectively.
Figure 7C:
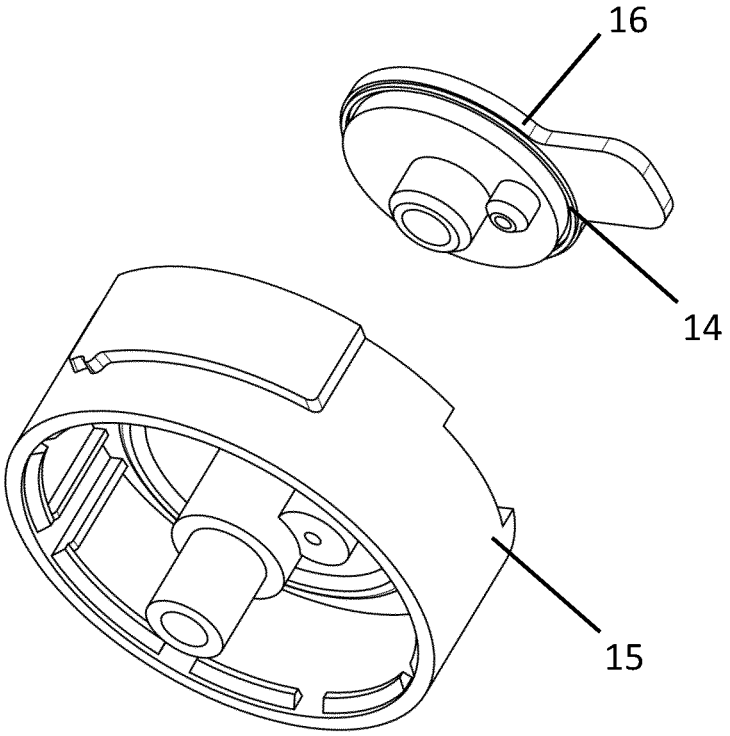

The cap 4 shown in FIGS. 7*a* to 7*c* is different from that shown in FIGS. 5*a* and 5*b* in the shape of the top plate 16 and the connection between the top plate 16 and the cap body 15.

In the closed state shown in FIG. 7*a*, the top plate 16 and the cap body 15 are integrated into one piece, and flush with each other at top. Instead of the hinge 29 which connects the top plate 16 with the cap body 15 in Example 1, the cap 4 in this example adopts a loop formed as a weakening portion 14 as shown in FIG. 7*c*. The weakening portion 14 is an integral part of the top plate 16 and the cap body 15 before the top plate 16 is removed. After removal, the weakening portion 14 is disconnected from the cap body 15. The weakening portion 14 as a thinned portion of 0.5 mm thick extends all along the main body 30 of the top plate 16 in a circumferential direction.

With reference to FIGS. 7*a* and 7*b*, the top plate 16 includes the main body 30 and a grasping part 31 extending therefrom, just like those in Example 1, but with no connecting part 32. The main body 30 and the grasping part 31 are embedded in the recess 20, more specifically, the respective central portion 21 and strip portion 22 of the recess 20 as shown in FIG. 7*b*, at top of the cap body 15.

An annular extension 27 is provided in the recess 20 in the circumferential direction to receive the weakening portion 14 as shown in FIG. 7*b*. The extension 27 extends all along the recess 20 in the circumferential direction corresponding to the weakening portion 14.

When the container 1 is to be attached to the dispensing device, a user grasps the grasping part 31 of the top plate 16 and pulls it away from the cap body 15 to break the weakening portion 14, thereby removing the top plate 16 from the cap 4.

With the easily torn off weakening portion 14, users may easily tear off the top plate 16 through a simple one-step operation by hand before using the container 1, which greatly improves user experience.

The invention claimed is:

1. A cap for a container to be mounted on a container body comprising:

(i) a cap body formed with a liquid path and a gas path therein, wherein the liquid path is configured for liquid to go through from the container and the gas path is configured for gas to go through to balance pressures inside and outside the container, wherein the cap body comprises a top wall with a recess through which both the liquid path and the gas path extend, and a peripheral wall extending from the top wall with a plurality of L-shaped ribs protruding from the peripheral wall and extending circumferentially and vertically along the peripheral wall for connecting the cap to a dispensing device, and (ii) a top plate;

characterized in that the top plate is detachably connected with the cap body to seal the liquid path and the gas path such that the top plate fully detaches from the cap body when the container is to be mounted onto the dispensing device; and wherein the top plate is connected with the cap body solely via a tear off structure comprising one or more of: weakening lines, a hinge, a weakening portion, a loop, perforated holes, thinned portions, cutouts, and notches.

2. The cap according to claim 1, wherein the top plate serves as a sealing member to seal the liquid path and the gas path, and also as an outer cover for the cap.

3. The cap according to claim 1, wherein the tear off structure is provided with a weakening portion.

4. The cap according to claim 1, wherein the tear off structure is in the form of a hinge.

5. The cap according to claim 2, wherein the tear off structure is in the form of a loop extending at least partly in a circumferential direction.

6. The cap according to claim 1, wherein the top plate is dimensioned to be received in the recess.

7. The cap according to claim 1, wherein the top plate is dimensioned to be extended above and beyond the recess.

8. The cap according to claim 1, wherein the top plate is provided with two protrusions to be press fitted into a liquid outlet and a gas hole, which are provided in the cap body as part of the liquid path and gas path, respectively.

9. The cap according to claim 1, wherein a tube is arranged at the cap body to communicate with the liquid path.

10. The cap according to claim 1, wherein the cap is integrally formed into a single piece.

11. A container comprising a container body and a cap according to claim 1 configured to be mounted on the container body.

12. The container according to claim 11, wherein the container body and the cap are releasably engaged using a snap-fit connection.

13. The container according to claim 11, wherein a tamp-proof feature is arranged between the cap and the container body to prevent the cap from being removed.

14. The container according to claim 11, wherein the cap body is provided with an annular protrusion to be press fitted into an opening of the container body.

15. The container according to claim 13, wherein the tamp-proof feature is an interlocking structure.

16. The container according to claim 15, wherein the interlocking structure is configured as a pair of barb-like flanges extending circumferentially.

17. The cap according to claim 1, wherein the loop is provided with a notch for tearing.

* * * * *